US005737897A

United States Patent [19]

Naipawer, III

[11] Patent Number: 5,737,897

[45] Date of Patent: Apr. 14, 1998

[54] INSULATION BOARD COMPOSITE

[75] Inventor: Michael P. Naipawer, III, Bloomingdale, N.J.

[73] Assignee: Building Materials Corporation of America, Wayne, N.J.

[21] Appl. No.: 831,259

[22] Filed: Apr. 7, 1997

[51] Int. Cl.[6] ..... E04D 5/04

[52] U.S. Cl. ..... 52/796.1; 52/746.11; 52/DIG. 16

[58] Field of Search ..... 52/105, DIG. 16, 52/746.11, 796.1

[56] References Cited

U.S. PATENT DOCUMENTS 4,045,265 8/1977 Tajima et al. ..... 52/746.11 X 4,670,071 6/1987 Cooper et al. ..... 156/71

4,996,803 3/1991 Karrfalt et al. ..... 52/746.11 X

*Primary Examiner*—Christopher Kent

*Attorney, Agent, or Firm*—Walter Katz; Marilyn J. Maue; William J. Davis

[57] ABSTRACT

This invention relates to commercial roof assemblies applied over a flat roof deck, and, more particularly, to an insulation board composite capable of peel and stick application, in which the insulation board is mechanically attached to a roof deck, a release sheet is removed from the top face of the board (revealing the pressure sensitive adhesive layer), and a non-adhesive waterproofing membrane is then placed onto the adhesive face of the board.

5 Claims, 1 Drawing Sheet

INSULATION BOARD COMPOSITE

BACKGROUND OF THE INVENTION

1. Field of the Invention

This invention relates to commercial roof assemblies applied over a flat roof deck, and, more particularly, to an insulation board composite capable of peel and stick application, in which the insulation board is mechanically attached to a roof deck, a release sheet is removed from the top face of the board (revealing the pressure sensitive adhesive layer), and a non-adhesive waterproofing membrane is then placed onto the adhesive face of the board.

2. Description of the Prior Art

It is known in the roofing art to apply an insulation board between a waterproofing membrane and a roof deck by hot mopping of asphalt at 500° F. or by torching or open fire adherence. Cold adhesion with adhesives containing volatile components also is known. However, all of these methods have serious disadvantages because of safety and environmental concerns.

Accordingly, it is an object of this invention to provide an insulation board composite; mechanically fastened to a roof deck that is capable of peel and stick application for adherence of a waterproofing membrane.

Another object herein is to provide a rigid, dimensionally stable insulation board composite suitable for cold temperature adherence of a waterproofing membrane without requiring adhesives containing harmful volatiles.

Yet another object of the invention is to provide such an insulation board composite which includes an insulation board having a tacky, pressure sensitive, solid at room temperature adhesive coating thereon and a releasable sheet thereon.

These and other objects of the invention will be made apparent from the following more particular description.

SUMMARY OF THE INVENTION

This invention relates to commercial roof assemblies applied over a flat roof deck, and, more particularly, to an insulation board composite capable of peel and stick application, in which the insulation board is mechanically attached to a roof deck, a release sheet is removed from the top face of the board (revealing the pressure sensitive adhesive layer), and a non-adhesive waterproofing membrane is then placed onto the adhesive face of the board.

In suitable embodiments of the invention, the adhesive layer comprises asphalt and styrene-butadiene-styrene (SBS) polymer, preferably in a ratio of about a 90%–10% by weight ratio; and the insulation board comprises predominately paper and perlite, also including emulsion asphalt and starch.

DETAILED DESCRIPTION OF THE INVENTION

Figure 1:
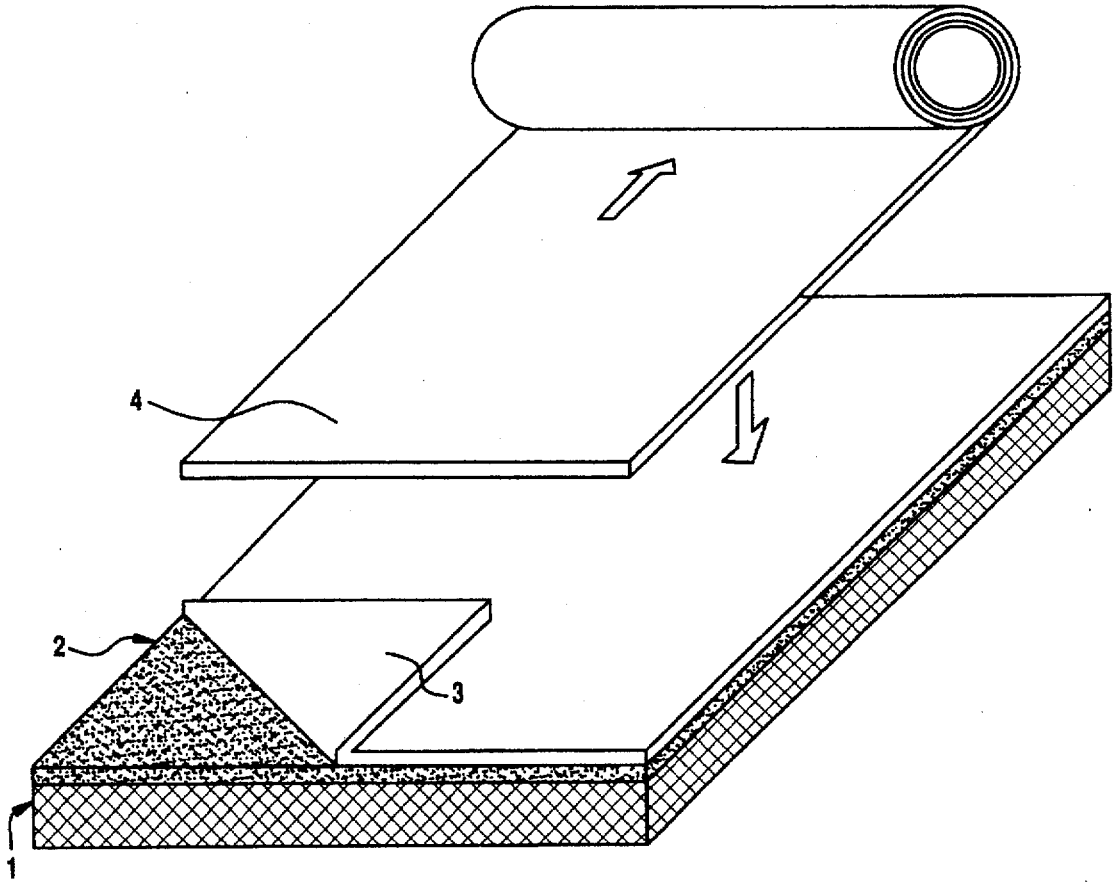
FIG. 1 is a schematic cross-sectional illustration of a composite of the present invention.

The FIGURE shows the insulation board composite 1 of the present invention which is designed for peel and stick application onto a waterproofing membrane and mechanical fastening to a roof deck. The composite comprises a rigid, dimensionally stable substrate composition board 1 which suitably is made of about 67% perlite, about 27% paper, about 5% emulsion asphalt and about 1% starch. The insulation board body is available from BMCA Insulation Products as "Permalite" roof insulation, typically in 4–8 ft. lengths, 2–4 ft. widths and 0.3–3 inch thickness.

Onto the insulation board is applied a tacky, pressure sensitive coating which is solid at room temperature such as adhesive coating 2. Typically it comprises asphalt and styrene-butadiene-styrene (SBS) polymer, in a 90%–10% weight ratio. The adhesive coating may be applied with a hot roller, extruded or coated via a blade coater, etc. at about 200°–400° F. to a thickness of about 0.05–0.15 inches to become integral with the substrate and exhibit a long shelf life.

A releasable sheet 3 then is applied over the adhesive layer to protect it before use. The release sheet comprises an outer layer of release paper or plastic film which is positioned on the adhesive layer. The release sheet may have a spaced apart sites or indicia imprinted thereon which are used for positioning fasteners, such as nails, to attach the insulation board composite to the roof deck.

In operation, the composite is applied onto the roof deck and attached thereto. The release paper then is removed and the waterproofing membrane 4 then is secured to the adhesive layer. Suitable waterproofing membranes include asphalt modified styrene-butadiene-styrene, EPDM, APP, PVC, SBR, fiber glass base sheet, and the like.

While the invention has been described with particular reference to certain embodiments thereof, it will be understood that changes and modifications may be made which are within the skill of the art. Accordingly, it is intended to be bound only by the following claims, in which:

What is claimed is:

1. An insulation board composite capable of peel and stick application of a waterproofing membrane and mechanical fastening to a roof deck comprising:

a rigid, dimensionally stable insulation board, a tacky pressure sensitive adhesive coating thereon comprising asphalt and styrene-butadiene-styrene (SBS) polymer suitable for cold adherence of said board to said membrane, and a releasable sheet on said coating.

2. An assembly according to claim 1 wherein said adhesive layer comprises about 90% by weight asphalt and about 10% by weight of SBS polymer.

3. An assembly according to claim 1 wherein said insulation board comprises predominately paper and perlite.

4. An assembly according to claim 3 in which said board also includes emulsion asphalt and starch.

5. An insulation board composite capable of peel and stick application of a waterproofing membrane and mechanical fastening to a roof deck comprising:

a rigid, dimensionally stable insulation board, a tacky pressure sensitive adhesive coating thereon comprising asphalt and styrene-butadiene-styrene (SBS) polymer suitable for cold adherence of said board to said membrane, and a releasable sheet on said coating, wherein said releasable sheet comprises an outer layer of peelable film having an inert layer of a plastic film on said adhesive layer.

* * * * *